United States Patent [19]

Rinaldi

[11] 4,224,891

[45] Sep. 30, 1980

[54] SEMI-SUBMERSIBLE VESSEL HAVING A SEALED CLOSED CHAMBER OF TRUNCATED OVOID SHAPE

[76] Inventor: Victor Rinaldi, 269, Cours de l'Argonne, 33000 Bordeaux, France

[21] Appl. No.: 921,173

[22] Filed: Jul. 3, 1978

Related U.S. Application Data

[63] Continuation of Ser. No. 699,089, Jun. 23, 1976, abandoned.

[30] Foreign Application Priority Data

Jun. 27, 1975 [FR] France ..... 75 20349

[51] Int. Cl.[2] ..... B63B 39/00

[52] U.S. Cl. ..... 114/256; 114/264

[58] Field of Search ..... 114/264, 265, 56, 266, 114/258, 261, 121, 125, 124, 256; 405/203, 205, 207, 210

[56] References Cited

U.S. PATENT DOCUMENTS

| | | | |
|---|---|---|---|
| 3,673,975 | 7/1972 | Strauss | 114/264 |
| 3,830,176 | 8/1974 | Arita et al. | 114/265 |
| 3,949,693 | 4/1976 | Bauer et al. | 114/124 X |
| 4,010,704 | 3/1977 | Mayo et al. | 114/125 X |

*Primary Examiner*—Douglas C. Butler

*Attorney, Agent, or Firm*—Bucknam and Archer

[57] ABSTRACT

Semi-submersible vessels are described comprising one or more modules each comprising a sealed chamber of annular cross-section, a partially immersable support structure secured to the chamber and a platform or deck carried by the support structure. The support structure is preferably comprised by a network of tubular members and preferably the sealed chamber comprises a plurality of toroidal storage reservoirs and ballast tanks. The support structure and chamber can together be in the form of a truncated ovoid narrow end uppermost. In an alternative embodiment the chamber is in the form of an inverted bowl and receives a dome like storage reservoir therein.

34 Claims, 11 Drawing Figures

SEMI-SUBMERSIBLE VESSEL HAVING A SEALED CLOSED CHAMBER OF TRUNCATED OVOID SHAPE

This application is a continuation of U.S. Ser. No. 699,089 filed June 23, 1976, now abandoned.

The present invention relates to semi-submersible vessels and more especially to marine platforms which may be used, in various embodiments as loading stations in oceanic waters and deep waters, drilling platforms, and mobile or stationary bulk loading vessels.

The general layout of a semi-submersible structure is the following: a horizontal deck is disposed at the upper level for the purpose of supporting working equipment. In all cases it is to be protected, as far as possible, against the action of swell. The keel is formed of an assembly of vertical cells or piers which connect this deck to a skeleton situated at a lower submerged level and either formed of parallel or intersecting horizontal cylinders or of independent caissons, the rigidity of the assembly being ensured by cross bars. Such a design affords a stability of the deck in the swell which, although greater than that of a conventional ship floating entirely at the surface nevertheless remains affected by roll and pounding, especially under conditions of heavy seas. According to this design the number of floatation cells is of little importance. The volume intercepted by the waves is great because of the necessity of holding considerable loads on the deck. On the other hand, for economic reasons and of problems of stresses in the structure it is difficult to construct according to this design hugh structures the inertia of which would be a decisive factor in their stability.

The principle aim of the invention is to offer a type of semi-submersible structure which may be constructed economically of very large size and which has very good stability in a swell.

Such a vessel may be used as a working tool and a scientific tool for the exploitation and exploration of oceanic resources in fields as varied as aquaculture, marine oil, the extraction of polymetallic nodules from the sea beds or the extraction of thermal energy from the sea.

According to the invention there is provided a semi-submersible vessel comprising at least one element or module of annular shape when viewed in cross section formed by a sealed closed chamber of variable ballast at the lower portion, on which there is secured a support structure which is partially immersable in use and which carries at its upper portion a horizontal deck. The chamber can be provided with a controllably variable quantity of ballast at its lower part, to which there is secured the support structure in the form of a partially immersed lattice work carrying the horizontal deck.

The horizontal deck disposed at the upper level can be well protected against the action of swell and may be of any convenient shape and especially have that of a right prism the horizontal cross section of which is either a square or an equilateral triangle or a hexagon. The deck rests on the top of the sealed chamber through the intermediary of the spacial structure of tubular framework the buoyancy of which is positive. The sealed chamber is utilised for storing various fluids the density of which is generally lower than that of sea water. This chamber is provided with internal tanks as well as with a ballast of concrete, so as to adjust the draught of the module and to ensure it of a major righting moment by the control of the displacement of the centre of gravity respectively of the centre of buoyancy of the immersed portions of the module.

The advantage resulting from the use of a spacial structure instead of a limited number of cells of large diameter arranged in a confined perimeter is to disperse in a large space a volume comparable to that of the cells, by means of a three-dimensional tubular network. The said network, because it may be made of tubes of relatively small cross section, offers little resistance to passage of the swell and, moreover, possesses great inertia.

Preferably the or each module is constructed in such manner as to utilise as much as possible the structural rigidity of ovoid shells. Thus the spacial structure and the chamber together preferably occupy a space which is similar to that of an egg-shaped shell which is truncated at its two ends along planar sections perpendicular to its axis of symmetry, the thickness of the ovoid shell increasing regularly from the more pointed to the more rounded end. The object of this varying thickness is on the one hand to stiffen the base of the module and on the other hand to provide the said module with an internal chamber of great capacity. Thus this chamber has in cross section an ovoid shape, without a bottom, to the edge of which there is rigidly secured the circular base of the ovoid segment formed by the support structure.

It is desirable for the height of the chamber to be about half of that of the supporting structure. The rounded shape of the chamber makes it possible to provide the latter with a well which extends symmetrically with respect to its axis of symmetry and is open at its top and at its lower end for communication between the bowl shaped space inside the bottom portion of the module and the ambient liquid in which the vessel is floating. Moreover, the module can in this way rest in stable equilibrium on the lower end of the well. This well enables, inter alia, the vertical passage of loads and various materials between the deck and the bed of the sea. It also makes possible the creation of a vast en closure of calm water internally of the concave portion of the reservoir when the latter emerges sufficiently above the waves. The utilisation of such a sanctuary is two-fold; on the one hand this sanctuary can be utilised as a sheltered port so as to facilitate access to the module from surface vessels of medium tonnage and, on the other hand, it enables the module to be stabilised. In fact, the water level and its pressure on the water within the sanctuary are established by the water pressure at the inlet orifice of the well. Since there is a pressure integration effect with increasing depth the pressure at the entrance to the sanctuary or shelter is more uniform than is the surface of the water which is swept by wind and waves around the module. Thus the surface of the water in the shelter is translated into a level which is much more even and uniform than the surrounding sea, as a function of the depth of immersion from the entry of the well of the emergent reservoir. It results therefrom that the waterline in the shelter is more constant by reacting not only on a craft which floats on its surface but also on the inner walls of said reservoir. Access to the shelter for a surface vessel is effected through an opening made in the spacial support structure which rests on the chamber, producing the sanctuary of calm water. In this manner the surface vessel may enter into the enclosure formed by the spacial support structure and then, by progressive emergence of the module, it is captive in the sanctuary, sheltered from waves and currents. It is preferable for the opening to be fashioned in the lower portion of the spacial support structure.

Another useful property of ovoid shells lies in the weak roll to which they are subjected when, by suitable ballasting, they float on their rounded end. Thus the module which is provided with a suitable ballast inside its chamber may sail thereon and be subjected to only a weak roll. From the preceding considerations it results that when a platform floats on the sealed chamber of the modules of which it is formed the stresses which are present in the cross bars between the modules remain moderate.

The spacial support structure of a module may preferably be an approximation of an ovoid segment by means of a three-dimensional network of metallic tubes which are rigidly assembled to one another by welding of their ends to the intersections of the network. This network is formed of two or more tubular skins of polyhedral surface. Different kinds of network may be utilised provided the length of the tubes is suitable with respect to their inherent stability, the span and the curvature of the spacial structure. Furthermore, each junction or intersection must serve for the rigid attachment of at most six to eight tubes and the volume of the tubes must be sufficient for the buoyancy of the structure to be substantially positive. It is thus desirable to take inspiration from the multi-skinned spacial structures which are at present used in architecture for the construction of domes of large dimensions, since the spacial structure of the module does not differ greatly from a segment of a sphere.

In another embodiment of the invention the junctions are hollow metallic spheres in which apertures have been made so as to receive the ends of the tubes welded thereinto.

According to one embodiment of the invention the buoyancy of the spacial structure is obtained by injecting a rigid, incompressible and positively buoyant material into the tubes of the structure. In order to accomplish this it is desirable to employ a synthetic foam obtained by embedding minute glass balls in epoxy resin, since this foam enhances the stiffness of the tubes.

According to a further embodiment of the invention the buoyancy of the spacial support structure is obtained by injecting compressed air at different pressures into an assembly of tubular sub-networks obtained by sealed off compartmentation of the tubular network of the spacial structure. These sub-networks which are each formed by an assembly of tubes which communicate with one another via junctions are superposed in horizontal strata in such manner that the compressed air supply pressure differs but little from the ambient pressure exerted thereon and varies by approximately one atmosphere every ten meters of depth from the surface.

The chamber may be divided into a plurality of toroidal spaces the axis of symmetry of which is that of the reservoir. The above mentioned spaces are moreover subdivided into small compartments by the use of bulkheads. It is possible to use these compartments for the storage of various fluids, for example crude oil, fuel, drilling sludge, soft water or liquefied gas. Some of these compartments may be equipped as living quarters, others as temporary sea water tanks, others as ballast for the reservoir. The advantages of providing a toroidal compartmentation of the sealed chambers resides in the possibility of maintaining each of said compartments at a higher pressure than that exerted thereon by the ambient medium, so at to improve the rigidity of the chamber; especially when the chamber partially rises above the waves, whereby its resistance to the impact of the waves is increased.

The cladding of the chamber is metallic. It is however, desirable for its lower portion to be of prestressed concrete so as to reduce maintenance requirements.

The ballasting of the reservoir is obtained by at least one toroidal compartment at the lower portion of the chamber which compartment is produced within a volume of concrete, its shape is similar to that of a volume of revolution about the axis of symmetry of the chamber and it is integrated in the lower portion of the chamber. Thus this volume is traversed by the well or shaft of the chamber. This ballast is made of honeycombed prestressed concrete and its toroidan compartments are fitted out as underwater accommodation. These accommodations operate at equal pressure with the ambient medium which partly penetrates into shafts fashioned in their respective decks. The buoyancy of the ballast is regulated by varying the level of water interiorly of the accommodations, as a function of the variations of positive buoyancy of the totality of fluids stored in the chamber.

When these buoyancies are inadequate or become negative sea water tanks are drained so that their respective buoyancies combined with the positive one of the spacial structure and the negative one of the ballast should keep the righting moment of the module at a sufficient value. The said seawater tanks are consequently disposed at some distance from the ballast, that is to say preferably in the upper portion of the chamber. The compartments of large capacity are always filled with liquid so as to limit the positive buoyancy; they are reserved for the storage of fluids the densities of which differ from that of sea water, since a charge of sea water is pumped into or out of the said compartments, depending on the variations of their loads of fluids; the discharged sea water is carefully filtered through separators so as to eliminate all traces of fluids which could cause any pollution of the marine environment. The toroidal compartment fashioned in the upper portion of the chamber which emerges when the module floats on its chamber are preferably tanks. Preferably these compartments can be made to emerge by evacuation of their load of sea water. This procedure is not mandatory to the extent of the chambers of an assembly being generally utilised as storage means when unfavourable conditions at sea inhibit both surface vessels collecting the stored fluid and the floatation of the assembly on its emergent chambers.

The diameter of the circle in which the polyhedral section of the deck is circumscribed preferably is chosen such as to be slightly larger than that of the maximum cross section of the external skin of the spacial support structure. The purpose of this configuration is to enable two modules to be coupled together by juxtaposition of one of their deck faces, with the parallelism of their axes of symmetry being abolished by the contact of the external skins of their respective spacial support structures. The above assembly is completed by the construction of a grid of tubular cross bars between the portions of the spacial structures of the modules which are proximate one another by virtue of the joining of their respective decks.

In the foregoing there was above all mentioned a closed chamber having the form of a truncated ovoid or the form of a hemispherical dome.

It has now been found that it is desirable to utilise an unbalanced sphere which pivots about a horizontal diameter passing through its geometric centre, since all the lines of action of the hydrostatic forces pass through this centre.

It should be noted that it is not essential for the surface of the chamber to be perfectly spherical, it is sufficient for it to be generally spherical.

By the expression "generally spherical surface" there are meant not only surfaces which are entirely and truly spherical but also curved surfaces which may depart from the truly spherical by minor accidentally occurring unevennesses and/or by the fact that these surfaces are totally or partly formed of non-spherical, curved or flat elements, for example portions of paraboloids and/or flat panels in the form of triangles, hexagons or other polygons, and/or by the fact that the chambers are not completely spherical in the scene that a minor portion, for example a small zone at one base, may be absent or not have been replaced and/or completed by a surface such as a conical flat or a differently curved surface, provided that the major portion of the surface is sufficiently close to a spherical surface for the lines of action of the great majority of hydrostatic forces acting on this surface to traverse a zone which surrounds its geometric centre and the volume of which is small in comparison to the total volume circumscribed by the surface.

For a chamber which has the form of a spherical segment the region surrounding the geometrical centre will be the larger as the height of the spherical zone is reduced.

One of the main objects of the invention is to modify the shape of a chamber in the form of a spherical segment having a base in such manner that, without changing its spherical surface and despite insufficient height, its stability continues to be similar to that of an unbalanced sphere.

The invention will become better understood from reading the following description of several exemplary embodiments illustrated in the accompanying drawings, in which.

Figure 1:
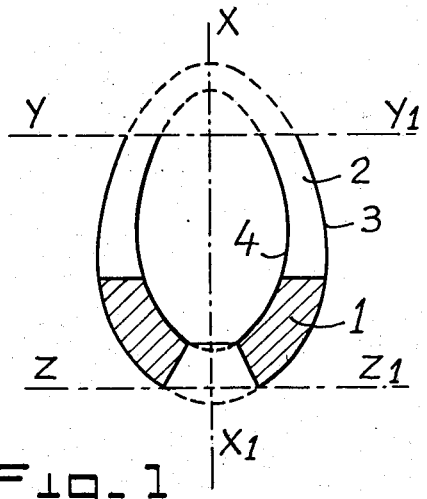
FIG. 1 is a view in schematic section of the form of an element or module of truncated ovoid shape.
Figure 2:
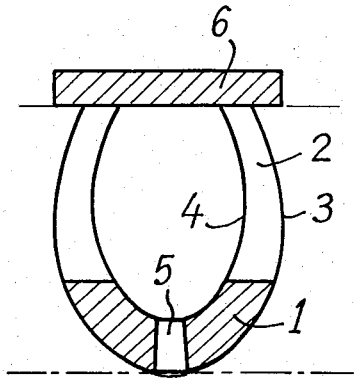
FIG. 2 is a view in schematic section of the element or module of FIG. 1 provided with a deck.

Referring to the drawings, in FIGS. 1 and 2 there is schematically shown a module or element of a semi-submersible vessel which has a generally ovoid form of axis $xx_1$ truncated at its two ends according to horizontal planes $yy_1$ and $zz_1$, the said module of annular form when viewed in horizontal section being defined by an internal face 4 and an external face 3 so as to form at its lower portion a closed sealed chamber 1 which is fillable to any required extent with a variable quantity of ballast and at its upper portion a grid support structure 2 which is partially immersed and carries at its top a horizontal deck 6 (FIG. 2).

The lower portion of the module has a central well which is open upwardly toward the structure 2 and at its bottom is in communication through an opening 5 with the liquid environment.

Figure 3:
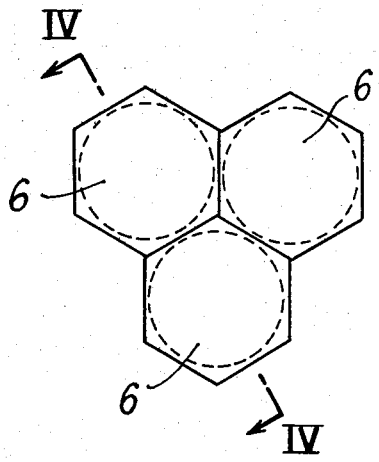
FIG. 3 is a plan view of an assembly of elements or modules constituting a vessel.
Figure 7:
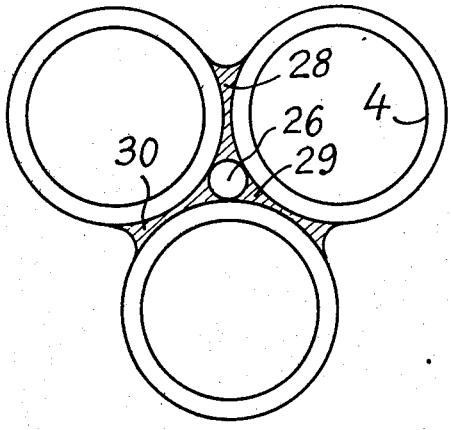
FIG. 7 is a view in section, to a smaller scale, taken along line VII—VII of FIG. 4.
Figure 4:
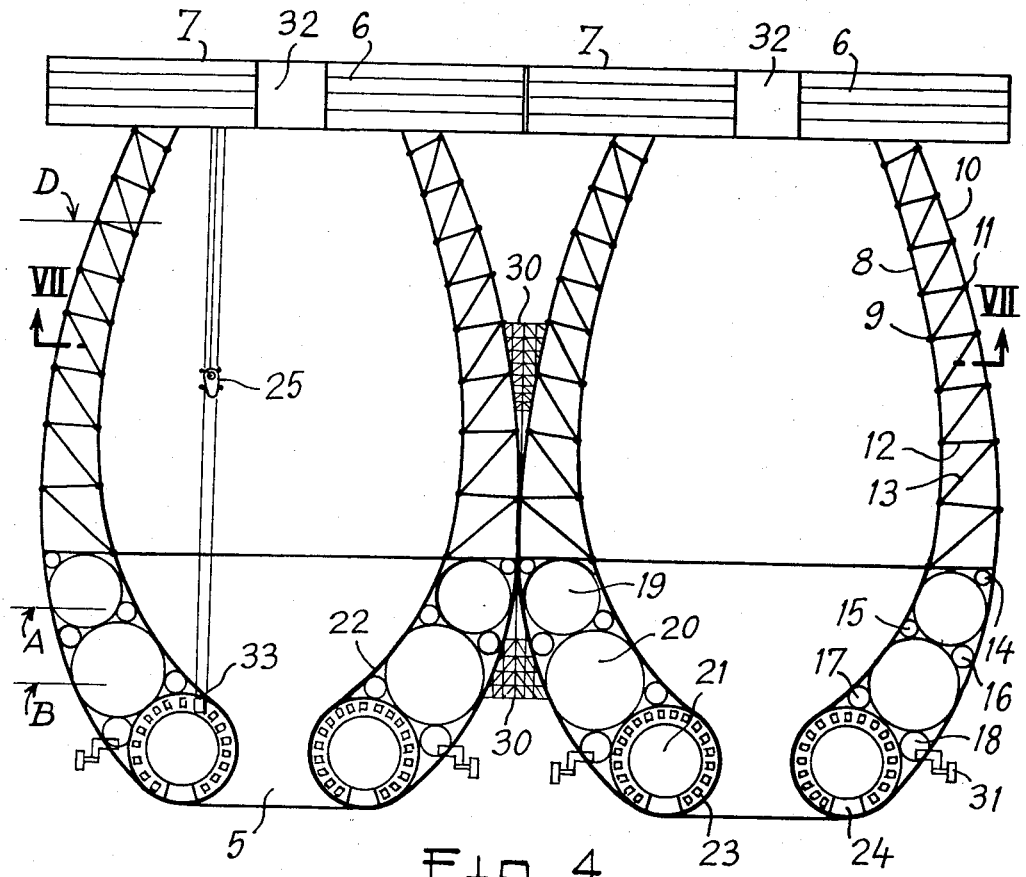
FIG. 4 is a view to a larger scale in vertical section along line IV—IV of FIG. 3.

In FIGS. 3 and 4 there is shown in greater detail an assembly of a plurality of the modules or elements forming a semi-submersible vessel, which modules are assembled and connected by a network of cross bars 28, 29, 30 (FIGS. 4,7).

The decks 6 which are preferably of hexagonal form are each constituted by a compartment having a plurality of bridging elements 7. Each deck 6 has a central shaft 32 therethrough which allows loads to be immersed from said bridge 7.

Figure 5:
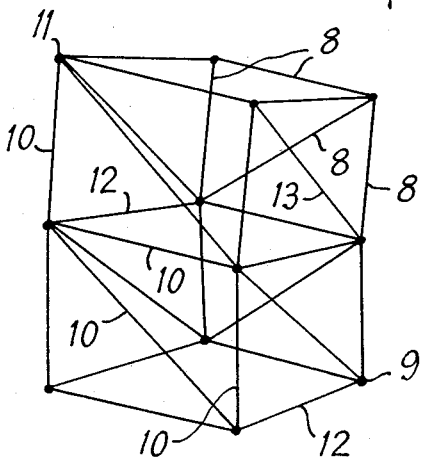
FIG. 5 is a view in perspective of supporting structure which carries the deck of the vessel.

The grid support structure 2 (FIGS. 4 and 5) is formed internally of the ovoid module by tubular elements 8 assembled at points or junctions 9 and on the outside by tubular elements 10 assembled at points or junctions 11. The junctions 9 and 11 are hollow metallic spheres pierced by openings into which the ends of the tubular elements are welded. It is alternatively possible to produce the junctions by welding together the ends of the tubular elements. The junctions 9 and 11 are disposed on the meridians which are common to the faces 3 and 4.

FIG. 4 is a section along one of the meridians and illustrates the arrangement of the junctions or intersections in each meridian, the said arrangement being realised as a function of the variation of thickness of the structure. Thus along each meridian the tubular linking elements 12 form together a planar tubular grid which is formed of a curved stack of substantially square quadrilaterals which are each provided with a tubular diagonal linking element 13.

Figure 6:
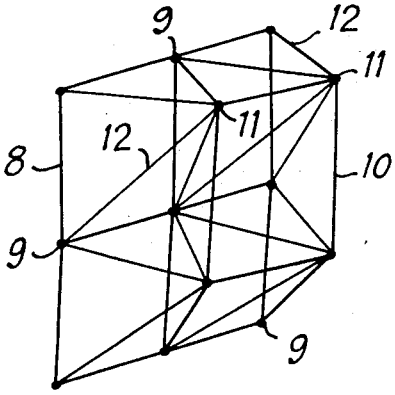
FIG. 6 is a view similar to FIG. 5 but showing another embodiment of the supporting structure.

In FIG. 6 there is shown a further embodiment of the support structure 2 wherein the internal face is criss-crossed by meridians and parallels; the junctions 9 being disposed at the intersections of this criss-crossed work. The junctions 11 of the internal skin are disposed on the external face 3 at the summit of substantially regular pyramids formed by the linking tubular elements 12 and the bases of which pyramids are the polygons of said criss-crossed work. The internal skin and the external skin are both formed by a tubular criss-crossed work between the respective junctions.

The sealed chamber of the module of FIG. 4 is subdivided into an assembly of toroidal compartments symmetrical about the axis $xx_1$ of the module. Smaller toroidal compartments 14, 15, 16, 17, 18 are inserted between toroidal compartments 19, 20, 21 of larger size and the cladding or outer wall of the chamber. The compartment 21 is formed interiorly of a ballast member 23 and is preferably constructed of honeycombed prestressed concrete. The assembly of toroidal compartments is sub-divided in radial manner such that the said compartments form a plurality of chambers each taking up a fraction of the toroidal configuration of the compartment.

The chambers of the ballast member 23 are utilised to receive a submarine workshop and to this end they are pierced at their base by a well or shaft 24 communicating with the ambient liquid medium. The workshops are each directly connected with the deck 6 of the module by means of a linkage capsule 25 which is received in a lock 33 of the ballast member 23.

The compartments 18 have installed therein electric motors or internal combustion engines which drive screws 31 orientated in various directions so as to enable the vessel to be maneuvered both for propulsion purposes and for its dynamic positioning.

The various pipes and fittings, command elements and other elements disposed between the chamber 1 and the deck 6 are housed interiorly of the framework of the structure 2 for protection against waves and the like.

Several depths of immersion are possible. Immersion to a water level A (FIG. 4) is used when the vessel is being sailed to a distance locality. It is also the level at which a calm water shelter can be provided in the concavities of its chambers 1 so as to protect surface craft floating therein when the seas are not too heavy. The arrow B indicates the minimum draught which can be achieve when the openings 5 of the modules are closed by aprons to permit the calm water tanks within the lower portions 22 of the modules to be drained by pumping. This minimum draught is used for the transit of the composite vessel in shallow waters, during its construction, or during the careening of its chambers 1. The draught of normal utilisation in semi-submerged state is indicated at D in FIG. 4.

In FIG. 7 the vessel is shown equipped with a central shaft between the modules forming the vessel. This shaft 26 is firmly secured to the deck of the vessel and to the tubular trellis work of cross bars 28, 29, 30 schematically shown in FIG. 7 by the volumes which they occupy and which, respectively, connect the modules of the vessel together. This shaft 26 permits an immersion from the deck 6 into a calm water chamber protected from the surface conditions of the surrounding sea or other liquid in which the vessel is floating. The shaft 26 may be equipped with a telescopic member mounted therein and provided with means whereby it can automatically be caused to project or to be retracted into the shaft. The extension of the shaft 26 may make possible a direct communication with the sea bed.

A module may be constructed in deep water on a cellular foundation raft which during the operation gradually sinks under the increasing weight of the construction. The bowl shape of the chamber 1 provides great stability for the gantry during building by virtue of the possibility of keeping a major portion of the interior of said bowl in a dry state, the shaft 5 being covered by the apron. Furthermore, as the assembly work progresses the successive compartments of the lower portion of the module are utilised as floats. The construction of the composite vessel is obtained by trimming and then rigidly securing the individual modules to one another.

The vessel may be utilised when it rests on the bottom, and for this purpose the compartments 21 are sunk and then used for storing liquids. Thus it may be positioned on the sea bed on a continental shelf and serve as bunkering port in deep water, as an island for the installation of industrial or tourism complexes, or as a farm for breeding marine species in ambient medium. This latter utilisation is made possible by fixing nets along the skins of the spacial structures of the top portions of the modules.

In waters of great depth a similar utilisation is possible by conventional anchoring or by dynamic positioning of the vessel and in this event the openings 5 are covered by nets. In deep waters which are poor in fish the surface waters may be enriched in nutrient materials by the creation of an artificial upwelling. For this purpose a system of pumps may be installed in the well 36 equipped with its telescopic extension, so as to bring the cold waters of the sea bottom which are rich in nutritive matter to the surface. It is advantageous to combine this artificial upwelling with the production of electricity by use of the thermal gradient of the seas. The central power station for this purpose is installed in one or more of the modules. When the central power station operates by freon or ammonia it is advantageous to instal its condensers in the upper portion and its evaporators in the lower portion. This is done so that, for a sufficient immersion of the vessel which is compatible with its stability, the pressure differences prevailing at these two levels between the ambient medium and the gas should be as low as possible, to permit the thickness of the walls of the said heat exchangers to be reduced accordingly. This reduction both enables the thermal output of the exchangers to be improved and reduces the considerable cost thereof which is caused by their fabrication of titanium in order to reduce the corrosive effect of sea water.

The cold water is brought up by pumping in the well 26 and its extension and is then conveyed into the condensers by means of branch ducts placed at the level of the points of contact of the upper edges of the reservoirs with the shaft 26. This water, having circulated through the condensers, is ejected out of the chambers via orientable pipes which enable the vessel to be propelled. The same applies to the hot water pumped to the surface which is channelled to the evaporators via ducts secured to the cladding of the concave portion of the chamber. The electrical energy produced by turbine generators installed at the outlet of the evaporators is utilised for producing hydrogen by electrolysis of the sea water. Reservoir compartments are arranged for storing this gas in liquid form.

An interesting application of the vessel is its utilisation as support for the extraction and processing of polymetallic nodules which cover the sea bed in certain localities.

Figure 8:
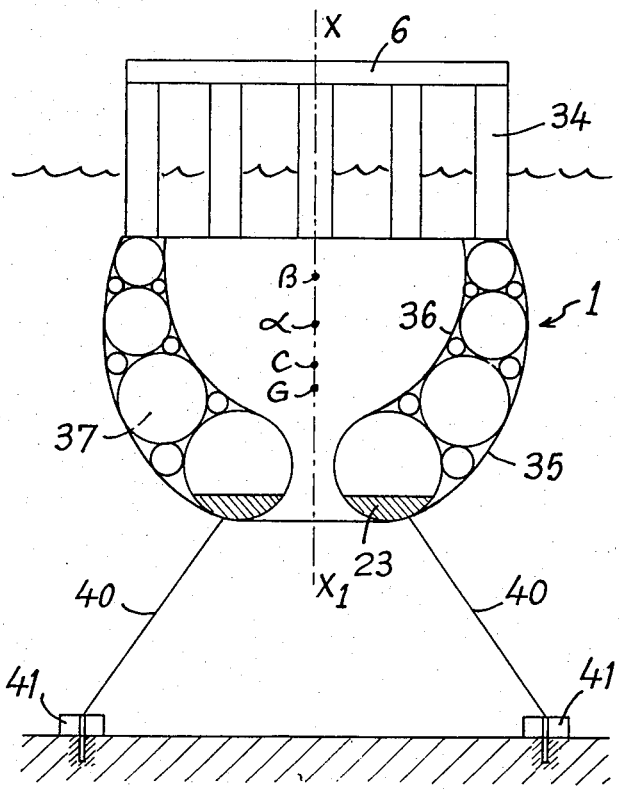
FIG. 8 is a view in axial section of an embodiment of a semi-submersible vessel having a spherical chamber.

In FIG. 8 there is shown a semi-submersible vessel comprising a closed, sealed chamber 1 having a variable ballast compartment 23 at its lower portion, and to which there is secured a structure formed of columns 34 which carries a horizontal deck 6 at its upper portion. The chamber 1 is normally submerged while the columns 34 of the structure are partially immersed.

The chamber 1 is defined by an outer wall 35 formed of a spherical zone the centre $\alpha$ of which is situated on the axis of symmetry $xx_1$ of the chamber and an inner wall 36 formed by a spherical zone the centre $\beta$ of which is situated on the axis of symmetry $xx_1$ of the chamber, these respective geometric centres $\alpha$ and $\beta$ of the spherical zones are situated on the geometric axis at a mutual spacing which is less than $\frac{1}{8}$ of the radius of the outer wall.

The centre of buoyancy C of the immersed parts is located on the axis of symmetry beneath the geometric centres $\alpha$ and $\beta$.

If the weight were to be concentrated at the centre of buoyancy C the body would be in static equilibrium and would be subject to free roll as a result of the action of the waves; but by virtue of its centre of gravity G being shifted below its centre of buoyancy C the vessel is unbalanced and swings like a pendulum about an axis of rotation to which the natural period of oscillation applies.

The vessel is ballasted in a fixed manner, more particularly by means of concrete in the ballast compartment 23 (FIGS. 8 and 9) which partly furnishes the righting moments necessary for keeping the deck 6 horizontal.

The interior of the chamber is generally divided into a plurality of toroidal spaces 37 (FIG. 8) coaxial with the axis of symmetry $xx_1$ of the chamber 1, or a plurality of cylindrical or annular spaces 38 (FIG. 9) associated with at least one toroidal space 37 at the upper portion of the chamber 1.

The inner wall 36 defines a semi-spherical cavity 39 which is open at its upper portion with its concavity directed toward the water level and which opens at the lower portion of the chamber 1 via the opening 5.

In the embodiment of FIG. 8 the vessel is moored to the bottom by cables 40 secured to dead weights on tethering bolts or anchors 41.

Figure 9:
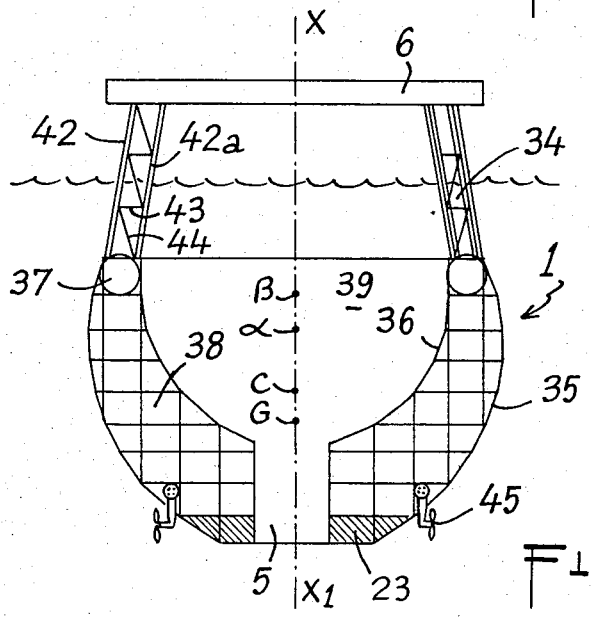
FIG. 9 is a view similar to FIG. 8 but showing a further embodiment of a vessel according to the invention.

In FIG. 9 there is shown a vessel wherein a support structure in the form of frustum of a cone supports the deck 6. The support structure is in the form of a network having two tubular skins which are each comprised of columns 42, 42*a* the axes of which coincide with the generatrices of the frustum of cone and which are interconnected by horizontal tubular cross-bars 43. Inclined tubular cross bars 44 link the skins and maintain them in rigid mutual relationship. This type of structure enables columns of large diameter to be inserted between the two skins of the structure so that there is closed access to the top of the chamber from the deck.

On the periphery of the chamber 1 there may be mounted, as shown in FIG. 9, propulsion motor groups 45 which are intended for its independent displacement and manoeuvering. These propulsion means are mounted so as to be individually rotatable about a vertical axis and permit propulsion in any direction.

Figure 10:
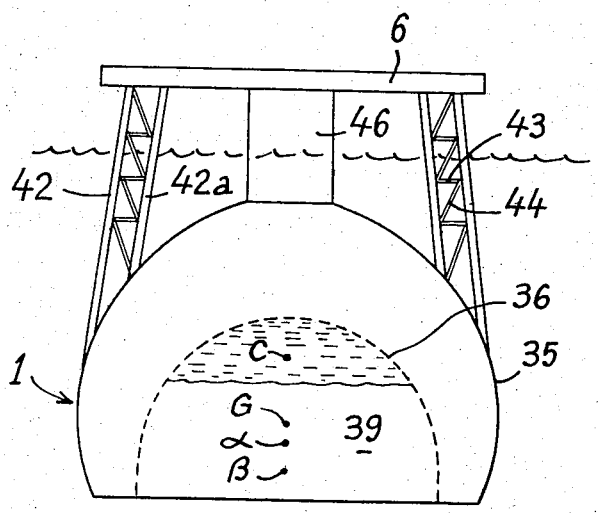
FIG. 10 is an elevational view of another embodiment of vessel, the concavity of which is directed downwardly.
Figure 11:
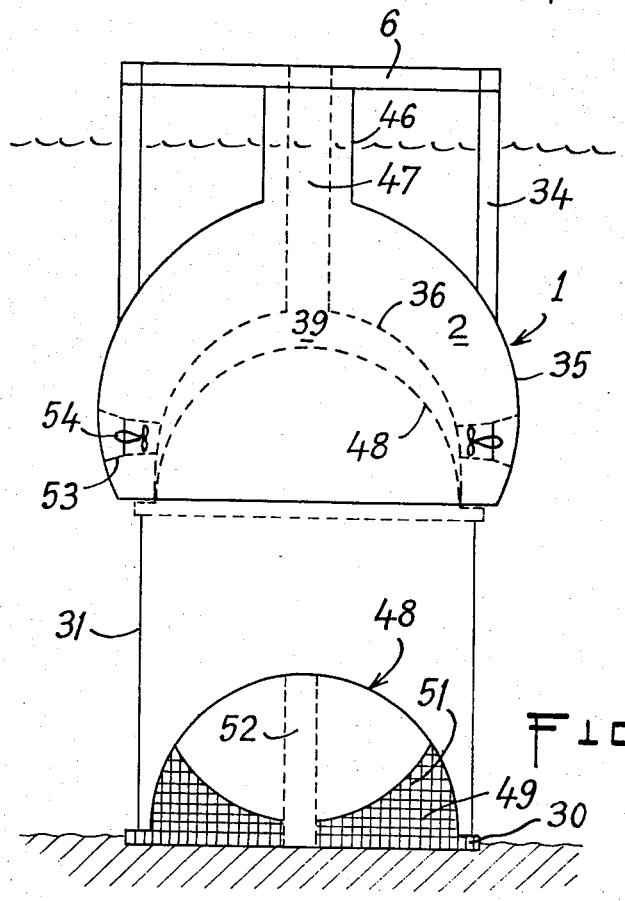
FIG. 11 is an elevational view of a modified embodiment of the vessel shown in FIG. 10 as employed for the transport of reservoirs.

In FIGS. 10 and 11 there is shown a semisubmersible vessel which is comprised of the same elements as in FIGS. 8 and 9, but the concavity of the chamber 1 is directed downward, that is to say away from the surface of the water level.

The linkage between the sealed chamber 1 and the deck 6 is formed either by means of a network as in FIG. 10 or by means of columns 34 as in FIG. 11, the assembly being completed by a central vertical column 46 having a shaft 47 adapted to permit various means and particularly drilling means to pass therethrough.

The chamber is unbalanced in such manner that its centre of gravity G is situated proximate and above the geometric centres $\alpha$ and $\beta$ of the external 35 and internal 36 curved surfaces of the chamber.

The moment of stability of the vessel is obtained by virtue of the fact that the centre of gravity G is below the centre of buoyancy C of the immersed portions of the vessel, which is very close to that of the chamber because of the small volume displaced by the immersed portion of the columns 46 and 34 relative to the displacement of the chamber.

The cavity 39 envisaged below the chamber 1 makes it possible to transport and to position large equipments, especially under-water tanks for storing crude oil.

In FIG. 11 there is shown a reservoir 48 which comprises an upwardly curved dome 49 of plane concave lenticular form. The dome 49 is made either of concrete or of steel with cells 51 which are intended to become lighter when they are partly or totally empty.

Inside the reservoir 48 there is provided a shaft 52 intended to enable drilling operations to be carried out from the deck of the vessel.

The dome 49, or indeed the module 35 itself, may provide, in urgent cases, an immense reservoir for storing crude oil by utilising the inverted bell which the dome and/or the chamber of the vessel forms.

Thus in the event of a leakage from the underwater reservoir and even when the internal storage reservoirs are full or of limited capacity it is possible temporarily to store crude oil in the central chamber itself of the module.

Should the compartments in the wall of the chamber 1 leak and lose their buoyancy, then the vessel can be kept afloat by injecting compressed air under the chamber the central shaft of which is hermetically closed.

For the purposes of propulsion and manoeuvering of the vessel there are provided, proximate the base of the chamber, tunnels or passages 53 wherein propulsion motor units 54 are accommodated.

I claim:

1. A semi-submersible vessel comprising one module formed by a sealed closed chamber, completely submerged in normal use, provided with ballast, means for varying said ballast, a support structure secured to the chamber, said structure being partially immersible in use, and a horizontal deck carried by the upper portion of the support structure wherein at least the lower portion of the vessel formed by the closed chamber has the form of a shell having the ellipsoidal shape of an egg with a pointed end and a less pointed end and being truncated along a plane perpendicular to the longitudinal axis, to retain the less pointed portion thereof and to eliminate the more pointed portion of the shell, wherein the lower portion of the vessel formed by the closed chamber opens at its upper portion toward the support structure and at its lower portion through an opening for communication with the liquid environment, said shell having an external and an internal curved wall such that the majority of their respective surfaces is close to a spherical surface whereby the lines of action of the great majority of the hydrostatic forces acting on said surface traverse a zone which surrounds its geometric center, the volume of said zone being small in comparison to the total volume circumscribed by said surface.

2. A vessel according to claim 1, the support structure being in the form of a network.

3. A vessel according to claim 2, wherein the network structure is formed of a tubular skeleton member which defines a double skin.

4. A vessel according to claim 2, wherein the network structure has a frustoconical form.

5. A vessel according to claim 4, wherein the network structure is formed of two tubular skins each comprised of columns having axes which merge with the generatrices of the frustum of the cone forming a grid, and horizontal cross bars and inclined cross-bars linking the said columns.

6. A vessel according to claim 2, wherein the network structure is provided with an opening for the passage of craft into the space defined by said structure when the said opening is partially submerged.

7. A vessel according to claim 1, wherein columns are provided regularly spaced about the periphery of the deck as the structure supporting the deck on the sealed chamber.

8 A vessel according to claim 1, including a central column supporting the deck on the chamber in the cavity provided in the central portion of the sealed chamber having a central shaft opening.

9. A vessel according to claim 1, wherein the lower portion of the vessel formed by the closed chamber has the form of a hemispherical dome.

10. A vessel according to claim 1, wherein the lower portion of the vessel formed by the closed chamber opens at its upper portion toward the support structure and at its lower portion through an opening for communication with the liquid environment.

11. A vessel according to claim 1, comprised of a plurality of said modules and assembly members linking the modules together.

12. A vessel according to claim 11, wherein the deck has a larger surface than the maximum cross-section of the external face of the closed chamber, and the modules are coupled by their decks.

13. A vessel according to claim 14, which is formed of a plurality of rigidly interconnected modules coupled by adjacent edges of their decks, and which comprises a trelliswork of tubular cross bars interconnecting the said structures and closed chambers of said modules.

14. A vessel according to claim 13, wherein a space is left free between adjacent modules and is provided with a vertical shaft which extends from the deck and establishes a communication with the water situated between the closed chambers of the modules.

15. A vessel according to claim 1, wherein said module comprises a propulsion member which renders it self propelled.

16. A vessel according to claim 15, wherein the closed chamber is provided with a plurality of propulsion members mounted so as to be individually rotatable about a vertical axis, enabling propulsion of the chamber in any direction.

17. A vessel according to claim 1 wherein the closed chamber is formed of a hull of which at least the lower portion is mainly made of prestressed concrete.

18. A vessel according to claim 1, wherein the sealed closed chamber comprises internal bulkheads forming a plurality of corresponding compartments.

19. A vessel according to claim 18, wherein certain of the bulkheads form tores co-axial with the axis of symmetry of the closed chamber, thus defining a plurality of toroidal spaces.

20. A vessel according to claim 19, wherein certain of these bulkheads are arranged to divide the toroidal spaces in radial manner so as to form compartments of fractions of annuli.

21. A vessel according to claim 20, wherein certain compartments defined by the bulkheads form reservoirs for collecting various fluids.

22. A vessel according to claim 21, wherein certain compartments form tanks, there being provided means for permitting entry thereinto of water of the ambient medium and means for emptying the tanks by injection of compressed air.

23. A vessel according to claim 21, which comprises means for replacing water of the ambient medium in each of said certain compartments with a load when loading is effected.

24. A vessel according to claim 21, wherein said certain of the compartments are in free communication with the water of the ambient medium by means of apertures through their respective bottoms.

25. A vessel according to claim 24, wherein the compartments contain underwater working means for operation at a pressure equal with that of the ambient liquid medium.

26. A vessel according to claim 18, wherein the bulkheads of the compartments situated at the lower portion of the closed chamber are made of prestressed concrete and form a means of ballasting the chamber.

27. A vessel according to claim 1, wherein the closed sealed chamber is defined by external and internal walls each in the form of a curved surface, the said internal wall defining a concave cavity open at its two ends.

28. A vessel according to claim 27, wherein the external and internal walls are formed by assembly segments each having a curved surface.

29. A vessel according to claim 28, wherein the concavity of the chamber is directed downwardly, the center of gravity of the module being situated beneath the center of buoyancy and above the geometric centers of the internal and external curved surfaces of the chamber.

30. A vessel according to claim 29, wherein the central cavity of the sealed chamber has mounted therein in removable manner a storage reservoir having an upwardly oriented spherical dome and a planar base adapted to rest on the underwater bottom.

31. A vessel according to claim 27, wherein the concavity of the chamber is directed upwardly and the center of gravity of the vessel is situated on the axis of symmetry beneath the center of buoyancy and the geometric centers of the internal and external curved surfaces of the chamber.

32. A vessel according to claim 27, wherein the sealed chamber is unbalanced at its lower portion by a mass of concrete and is internally divided by bulkheads forming a plurality of cylindrical toroidal spaces co-axial with the axis of symmetry of the chamber.

33. A vessel according to claim 27, wherein propulsion elements are disposed in horizontal passages fashioned substantially radially in the thickness of the chamber.

34. The vessel according to claim 1 wherein the thickness of the chamber increases gradually from the top to the bottom.

* * * * *